US007607190B2

(12) United States Patent
Moskovich et al.

(10) Patent No.: US 7,607,190 B2
(45) **Date of Patent: *Oct. 27, 2009**

(54) TOOTHBRUSH

(75) Inventors: Robert Moskovich, East Brunswick, NJ (US); Jouchim Storz, Zell am See (AT); Tanja Langgner, London (GB); Thomas Kuchler, Zell am See (AT)

(73) Assignee: Colgate-Palmolive Company, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/781,589

(22) Filed: Jul. 23, 2007

(65) Prior Publication Data

US 2008/0250593 A1 Oct. 16, 2008

Related U.S. Application Data

(63) Continuation of application No. 11/208,683, filed on Aug. 22, 2005, now Pat. No. 7,251,849, which is a continuation of application No. 10/442,307, filed on May 20, 2003, now Pat. No. 6,931,688.

(60) Provisional application No. 60/402,164, filed on Aug. 9, 2002.

(51) Int. Cl.
*A46B 9/04* (2006.01)
*A46B 7/06* (2006.01)

(52) U.S. Cl. ..... 15/167.1; 15/201

(58) Field of Classification Search ..... 15/22.1, 15/28, 167.1, 176.1, 176.4–176.6, 172, 194, 15/201, 202; D4/104, 105
See application file for complete search history.

(56) References Cited

U.S. PATENT DOCUMENTS 1,890,943 A 12/1932 Hoffman
2,263,802 A 11/1941 Grusin (Continued)

FOREIGN PATENT DOCUMENTS

DE 19817704 * 10/1999
FR 2621466 A 4/1989

(Continued)

*Primary Examiner*—Mark Spisich
(74) *Attorney, Agent, or Firm*—Amy M. Fernandez

(57) ABSTRACT

A toothbrush comprises a handle and a head. The head includes a first section having cleaning elements extending outwardly from its outer surface. A ball joint is mounted to the head adjacent to the first section. The ball joint also includes cleaning elements extending outwardly from the outer surface. The head includes resilient material urging the ball joint so be in its initial position after the pivotal movement of the ball joint cleaning elements.

10 Claims, 5 Drawing Sheets

U.S. PATENT DOCUMENTS

| | | | | | |
|---|---|---|---|---|---|
| 3,398,421 | A | | 8/1968 | Rashbaum | |
| 4,114,222 | A | | 9/1978 | Serediuk | |
| 4,633,542 | A | | 1/1987 | Taravel | |
| 4,654,922 | A | | 4/1987 | Chen | |
| 5,398,366 | A | * | 3/1995 | Bradley | 15/167.1 |
| 5,491,866 | A | | 2/1996 | Simonds | |
| 5,499,422 | A | * | 3/1996 | Lavazoli | 15/167.1 |
| 5,524,319 | A | | 6/1996 | Avidor | |
| 5,625,916 | A | | 5/1997 | McDougall | |
| RE35,941 | E | | 11/1998 | Stansbury, Jr. | |
| 6,088,870 | A | | 7/2000 | Hohlbein | |
| 6,408,473 | B1 | * | 6/2002 | Kessler | 15/104.94 |
| 6,553,604 | B1 | | 4/2003 | Braun et al. | |

FOREIGN PATENT DOCUMENTS

| | | | | |
|---|---|---|---|---|
| JP | 05-076416 | | | 3/1993 |
| JP | 06327517 | A | | 11/1994 |
| SU | 1752336 | | | 8/1992 |
| SU | 1752336 | A1 | | 8/1992 |
| WO | 97/32502 | | * | 9/1997 |
| WO | 0238004 | | | 5/2002 |

* cited by examiner

TOOTHBRUSH

CROSS-REFERENCE TO RELATED APPLICATIONS

This is a continuation of U.S. application Ser. No. 11/208,683, filed Aug. 22, 2005, now U.S. Pat. No. 7,251,849,which is a continuation of U.S. application Ser. No. 10/442,307, filed May 20, 2003, now U.S. Pat. No 6,931,688 which claims the benefit of U.S. Provisional Application No. 60/402,164, filed Aug. 9, 2002, which is incorporated by reference herein in its entirety.

BACKGROUND OF THE INVENTION

The present invention is directed primarily to a manually held toothbrush which would include a handle and a head. With conventional manual toothbrushes, cleaning elements, such as tufts of bristles, are mounted to the head. When toothpaste is applied to the cleaning elements the user inserts the head into the mouth and brushes the teeth in a known manner.

Conventionally, a toothbrush head is of one piece construction which is elongated and symmetrical in shape on each side of the longitudinal center line. Generally, the head includes fixed bristles extending outwardly from one surface of the head. Attempts have been made to provide additional flexibility to the bristles by permitting some movement of the bristles during use of the toothbrush. A number of patents, for example, disclose utilizing a pivotal or ball joint mounted on the toothbrush head to permit such movement. U.S. Pat. No. 5,491,866, for example, discloses an articulate toothbrush wherein a pivot joint connects the handle and head. All of the bristles are mounted to the pivotable head. U.S. Pat. No. 3,398,421 discloses a toothbrush wherein the head includes a pair of carriers each of which is retained by a ball member; alternatively, a single ball member is used for all of the carriers. No other bristles are included in the head. A similar approach is disclosed in patent abstracts of Japan publication no. 06327517.

Another approach is to have a plurality of individually mounted groups of bristles secured to a respective ball, such as disclosed in U.S. Pat. No. 2,263,802 and Russian patent SU 1752336. The head includes no fixed bristles. A similar approach is utilized in a hairbrush disclosed in U.S. Pat. No. 4,114,222.

U.S. Pat. No. 4,654,922 discloses a toothbrush with a universal joint for two segments located outwardly of the head with the joints being disposed in a longitudinal direction. Accordingly, the head actually includes the two separate sections which extend outwardly from the head. The head itself may also be attached to the handle by a ratchet ball.

U.S. Pat. No. 6,088,870 discloses a toothbrush having a flexibly mounted bristles wherein the bristles are mounted on a resilient lattice network.

SUMMARY OF THE INVENTION

An object of this invention is to provide a toothbrush wherein the toothbrush head includes cleaning elements, such as bristles, mounted on a ball joint to provide an extra degree of motion, in addition to fixed cleaning elements.

In accordance with this invention an elongated head is attached to the end of a handle. The head has an outer surface from which a plurality of cleaning elements extend. In addition, the head includes a further set of cleaning elements mounted to a ball joint located generally perpendicular to the outer surface so that these cleaning elements may move in various directions, including along the longitudinal axis of the head.

In a preferred practice of this invention the ball joint is located below the outer surface of the head. The ball joint includes an outwardly extending stem which in its initial position is perpendicular to the outer surface of the head. A carrier for the cleaning elements is mounted to the stem. The stem is surrounded by elastomer material to urge the stem back to its initial position.

The ball joint could be mounted to the head as a separate component which is snapped into place or could be joined into the cavity of the head by a flexible, resilient elastomer. The ball joint might be assembled via insert molding process.

DETAILED DESCRIPTION OF THE INVENTION

The present invention is directed to toothbrushes which are inserted in the mouth during use. Although the drawings illustrate a toothbrush which is manually operated, it is to be understood that the teachings of this invention could be incorporated in power operated or electric toothbrushes wherein a portion of the toothbrush head is, for example, oscillated such as by means of the type of drive illustrated in U.S. Pat. No. 5,625,916, all of the details of which are incorporated herein by reference thereto. Such a toothbrush would include at least one oscillating or rotating section and would also include at least one section wherein the cleaning elements are mounted on a ball joint as later described.

Figure 1:
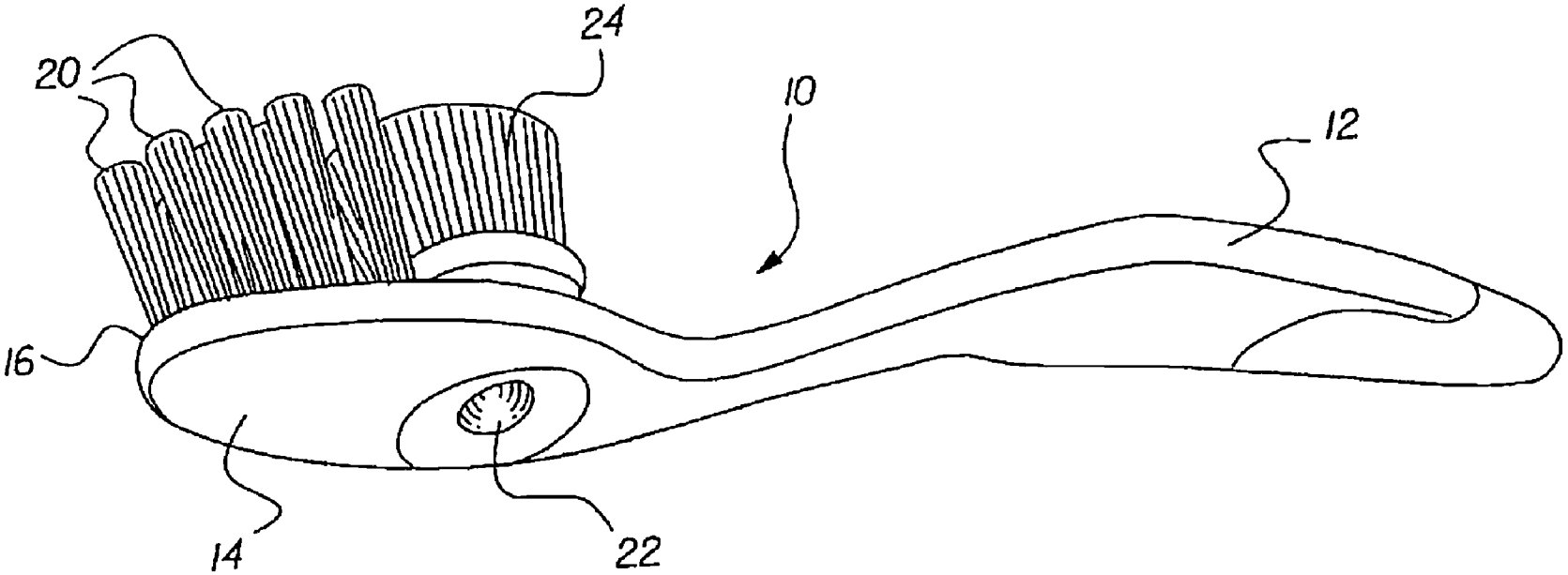
FIG. 1 is a perspective view of a toothbrush in accordance with this invention.
Figure 2:
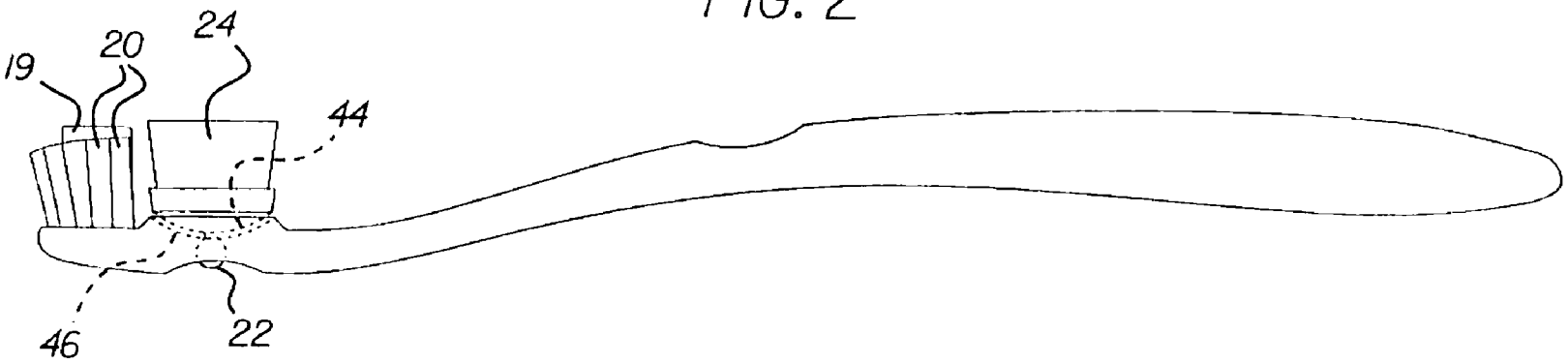
FIG. 2 is a side elevational view of the toothbrush shown in FIG. 1.
Figure 3:
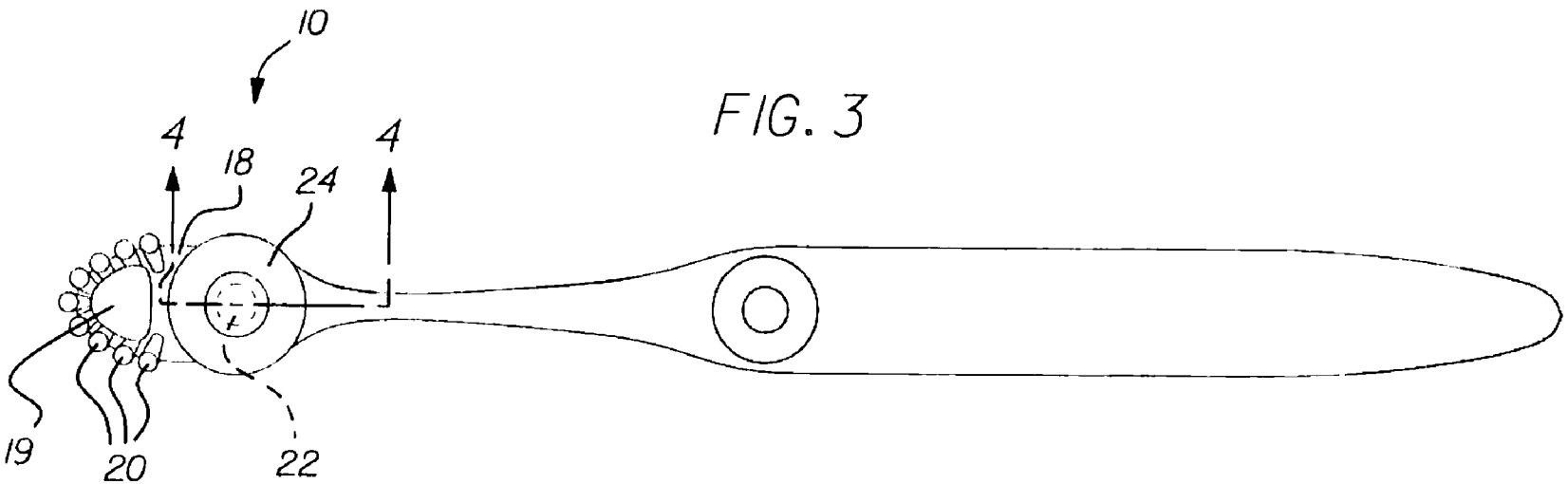
FIG. 3 is a front elevational view of the toothbrush shown in FIGS. 1-2.

FIGS. 1-3 show a toothbrush 10 in accordance with this invention. As shown therein toothbrush 10 includes a handle 12 and a head 14. Head 14 includes a fixed section 16 having an outer surface 18 from which various cleaning elements 19, 20 extend. Head 14 also includes a section located near handle 12 which includes a ball joint 22 having cleaning elements 24. The utilization of the ball joint 22 introduces an extra degree of motion other than flexing the bristle strands where bristles are used as the cleaning elements.

Figure 4:
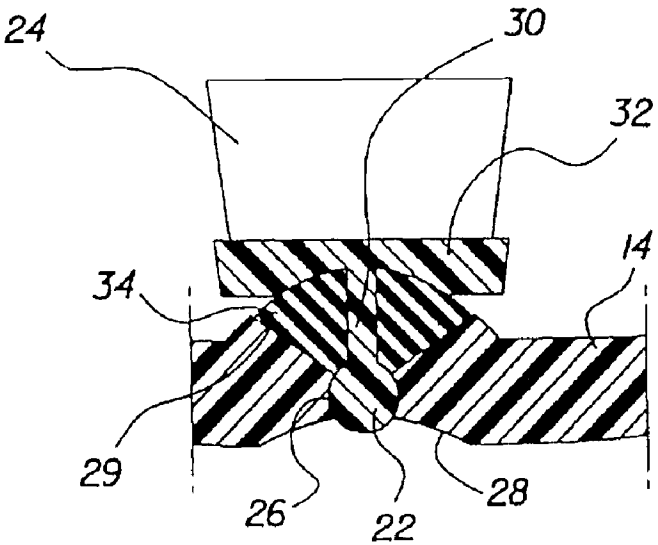
FIG. 4 is a cross-sectional view taken through FIG. 3 along the line 4-4.

The ball joint 22 could be mounted to head 14 in any suitable manner. FIG. 4, for example, illustrates a socket 26 located in a recess 28 on the underside of head 14, that is the side opposite outer surface 18. The ball joint 22 includes a neck or stem 30 connected to a carrier 32 with the cleaning elements 24 mounted to carrier 32. Stem 30 could be surrounded by elastomeric material 34 to fill the opening in head 14 necessary to accommodate the ball joint while still permitting universal type movement of ball joint 22.

As shown in FIG. 4 the bottom of carrier 32 is concave to complement the convex outer surface of elastomer 34 and head 14 to facilitate the pivoting of carrier 32. As also shown, ball joint 22, stem 30 and carrier 32 are integral.

Figure 5:
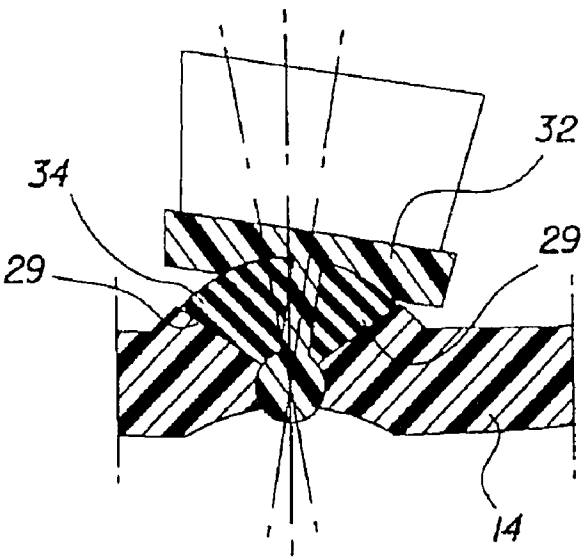
FIG. 5 is a view similar to FIG. 4 in a different phase of operation.

FIG. 5 illustrates ball joint 22 in its condition during use where the ball joint 22 has pivoted in a direction toward handle 12.

An advantage of incorporating elastomeric material such as elastomeric material 34 or the resilient pad 38 (FIG. 6) around the stem 30 of the ball joint 22 is that the elastomer 34 or 38 provides extra motion in returning the ball joint 22 to its initial rest position where the stem 30 is generally perpendicular to the longitudinal axis or outer surface of head 14.

Figure 7:
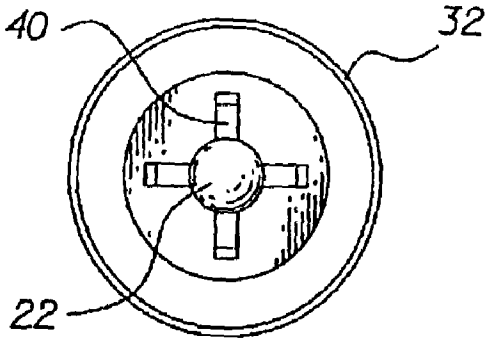
FIG. 7 is a plan view of the alternative shown in FIG. 6.
Figure 6:
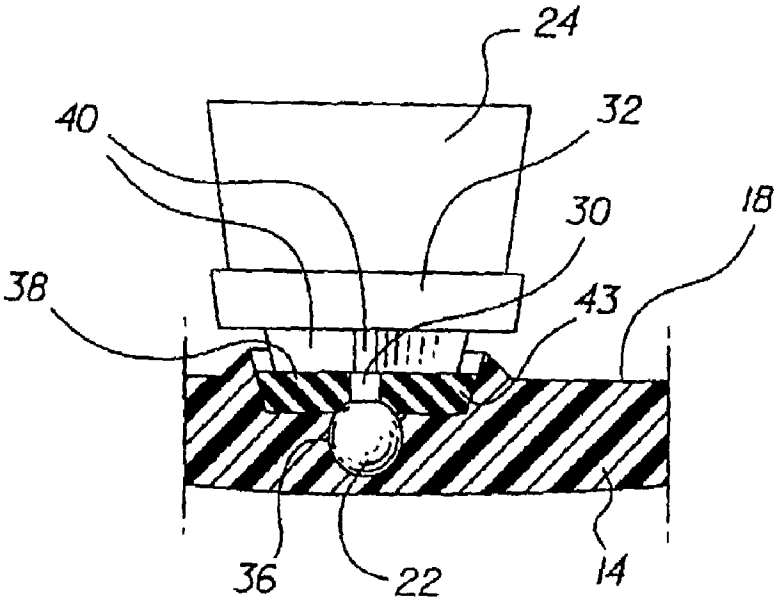
FIG. 6 is a view similar to FIGS. 4-5 of an alternative form of this invention.

FIGS. 6-7 illustrate an alternative manner of mounting the ball joint 22. As shown therein a socket 36 which is generally spherical in shape is formed in head 14. A resilient pad formed of elastomeric 38 is mounted over socket 36. Carrier 32 has depending ribs 40 which press against pad 38. During assembly, ball joint 22 is snapped into place through a central hole in the pad 38. When ball joint 22 is in socket 36, ribs 40 contact pad 38. Instead of forming the ball joint structure as a separate component, the ball joint could be incorporated in the head 14 via insert molding process.

In both of the embodiments of FIGS. 1-5 and FIGS. 6-7, the ball joint 22 is located recessed below the outer surface of head 14. The cleaning element carrier 32 is disposed above the outer surface and mounted for pivotal movement by its connection to stem 30. Stem 30 is surrounded by elastomeric material 34 or elastomeric pad 38 to bias stem 30 to its initial position perpendicular to the outer surface of head 14.

Although FIGS. 1-3 illustrate the ball joint 22 and its cleaning elements 24 to be located between the fixed section 16 and the handle 12, other arrangements are possible such as by having a further fixed section on the opposite side of ball joint 22 or by having the ball joint located at the remote or distal end and the fixed section located between the ball joint and the handle. Similarly, while FIGS. 1-3 illustrate only a single ball joint the invention could be practiced with multiple ball joints.

As best illustrated in FIG. 3 the cleaning elements 20 are located along the periphery of fixed section 16 in a generally U-shaped pattern. Cleaning elements 19 are located within the U-shape. Cleaning elements 19 may be shorter than cleaning elements 20 to create a cup-like outer surface of the ends of the cleaning elements 19, to help retain toothpaste on the cleaning elements. Cleaning elements 19 might be bristle bundles, while cleaning elements 20 might be in-molded technology bristles.

If desired, as shown in FIG. 2, the outer surface 18 of head 14 could include a concave depression 46 to accommodate a complementary shaped surface 44 of the ball joint structure. Alternatively, the outer surface 18 may have a convex protrusion which would accommodate a complementary shape concave portion of the ball joint structure, as shown in FIG. 4. These complementary surfaces facilitate the smooth movement of the ball joint carrier 32.

As shown in FIGS. 4-5 the outer surface of head 14 includes a recess 29 through which the stem 30 extends. The shape and dimension of recess 29 controls or limits the degree of pivoting that the cleaning elements 24 can make. In that regard, where the head 14 is generally formed from conventional hard plastic material the edges of the recess would function as a stop to limit the degree of pivoting action of the ball joint structure. FIG. 5, for example, shows the ball joint structure pivoted almost to the limit that would result where upon continued movement stem 30 contacts the edge of recess 29.

As shown in FIG. 6 head 14 includes a recess 43 into which the pad 38 would be mounted. The degree of pivoting permitted for the ball joint structure would be controlled by the size and dimension of the various components. Thus, the outer surface of head 14 would prevent further pivoting action of ball joint 22 when the carrier 32 contacts the outer surface 18.

As illustrated in FIGS. 4-5 the elastomer material 34 completely fills the open area in recess 29, thus, effectively functioning as biasing structure to urge the ball joint 22 back to its initial position where it is generally perpendicular to the longitudinal axis of head 14.

Although FIG. 3 illustrates the cleaning elements 20 to be a single row of tufts of bristles it is to be understood that the cleaning elements could be arranged in a plurality of rows. What is desired in the illustrated embodiment is that there should be an open area to accommodate cleaning elements 19.

Any suitable form of cleaning elements may be used as the cleaning elements 19, 20 and 24. The term "cleaning elements" is intended to be used in a generic sense which could include conventional fiber bristles or massage elements or other forms of cleaning elements such as elastomeric fingers or walls arranged in a circular cross-sectional shape or any type of desired shape including straight portions or sinusoidal portions. Where bristles are used, the bristles could be mounted to tuft blocks or sections by extending through suitable openings in the tuft blocks so that the base of the bristles is mounted within or below the tuft block.

It is to be understood that the specific illustration of the cleaning elements is merely for exemplary purposes. The invention can be practiced with various combinations of the same or different cleaning element configurations (such as stapled or in-molded technology bristles, etc.) and/or with the same bristle or cleaning element materials (such as nylon bristles, spiral bristles, rubber bristles, etc.) Similarly, while FIG. 2 illustrates the cleaning elements to be generally perpendicular to the outer surface 18 of head 14 some or all of the cleaning elements may be angled at various angles with respect to the outer surface of head 14. It is thereby possible to select the combination of cleaning element configurations, materials and orientations to achieve specific intended results to deliver additional oral health benefits, like enhanced cleaning tooth polishing, tooth whitening and/or massaging of the gums.

Although FIGS. 1-7 illustrate a manually operated toothbrush, the invention may also be practiced where the head includes one or more power or electrically operated movable sections carrying cleaning elements. Such movable section may oscillate in a rotational manner or may oscillate linearly in a longitudinal direction with respect to the longitudinal axis of the head or may oscillate linearly in a lateral or transverse direction with respect to the longitudinal axis of the head. The movable section may oscillate in and out in a direction toward and away from the outer surface of the head. The movable section may rock back and forth with respect to the outer surface of the head. The movable section may rotate continuously in the same direction, rather than oscillate. Any suitable drive mechanism may be used for imparting the desired motion to the movable section. Where plural movable sections are used, all of the movable sections may have the same type and direction of movement, or combinations of different movements may be used.

Figure 8:
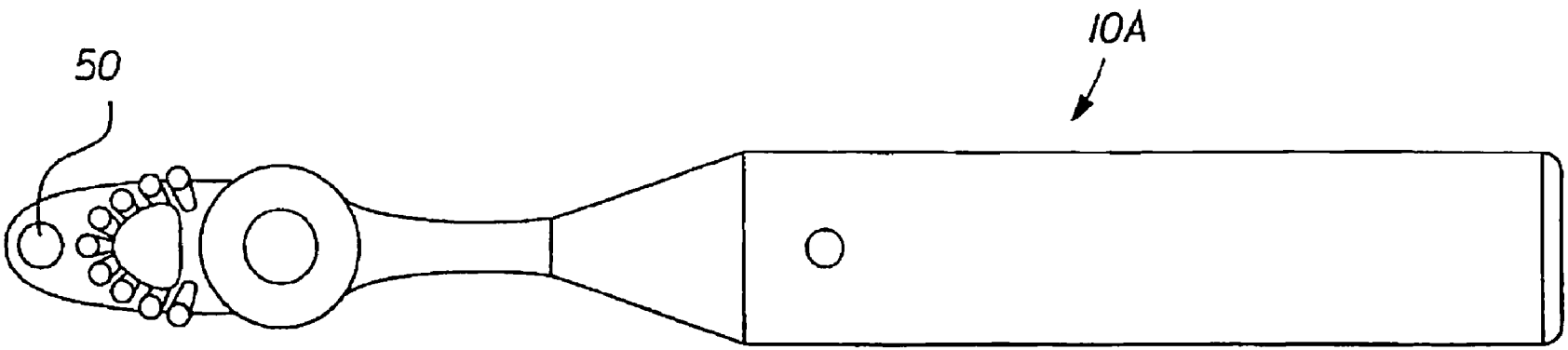
FIG. 8 is a front elevational view of a further toothbrush in accordance with this invention.

FIG. 8 illustrates a toothbrush 10A which includes a power driven movable disc or section 50 having cleaning elements. The movable section 50 could be oscillated rotationally such as by using the type of drive mechanism shown in U.S. Pat. No. 5,625,916, or could move in and out using the type of drive mechanism shown in U.S. Pat. No. Re 35,941, all of the details of both patents are incorporated herein by reference thereto. Alternatively, the other types of drives referred to above could move section 50 in other manners and directions. Although FIG. 8 shows movable section 50 to be at the distal end of the head, the movable section(s) could be located at any desired location on the head.

As should be apparent the toothbrush 10 or 10A provides a head wherein there is an extra degree of motion to the cleaning elements. This extra degree of motion is accomplished by providing cleaning elements on a ball joint structure in such a manner that the cleaning elements may freely move in virtually any direction from its initial nonuse position.

We claim:

1. A toothbrush comprising:

a handle, an elongated head mounted to said handle, said head having an outer surface, fixed cleaning elements mounted to said head and extending outwardly from said outer surface, movable cleaning elements mounted to said head by at least one movable carrier and extending outwardly from said outer surface, the carrier being connected by a stem to a joint that is pivotally received in a socket located recessed below the outer surface of the head, wherein said movable cleaning elements can be pivoted away from an initial position generally perpendicular to a longitudinal axis of the head in response to said movable cleaning elements contacting the teeth of the user causing pivotal movement of the joint in the socket, wherein the carrier is disposed above the outer surface;

a resilient material between said outer surface of said head and the carrier, the resilient material contacting a bottom surface of the carrier and the outer surface of the head, the resilient material surrounding the stem and biasing the movable cleaning elements in the initial positions, and wherein a portion of said joint is exposed from a surface of an underside of the head that is opposite the outer surface, wherein the socket is formed in a recess in the surface of the underside of the head opposite the outer surface of the head.

2. The toothbrush of claim 1, wherein the joint is snapped in the socket.

3. The toothbrush of claim 1, wherein the carrier, stem and joint are integral.

4. The toothbrush of claim 3, wherein the integral stem and joint extend completely through said head from said outer surface to said underside.

5. The toothbrush of claim 1 wherein the carrier is disposed above the outer surface so that a gap exists between the carrier and the outer surface of the head, the resilient material filling the gap so as to be in contact with the carrier and the outer surface of the head.

6. A toothbrush comprising:

a handle;

a head mounted to said handle;

a platform having cleaning elements extending from a top surface, the platform mounted to said head by a stem having a joint that is pivotally received in a socket located in the head, the platform disposed in a spaced manner from the head so that a gap exists between a bottom surface of the platform and the head;

resilient material filling the gap between the head and the bottom surface of the platform, the resilient material surrounding the stem and biasing the movable cleaning elements in an initial position; and wherein a portion of said joint is exposed from a bottom surface of the head, wherein the socket is formed in a recess in the bottom surface of the head.

7. The toothbrush of claim 6 wherein the resilient material has a convex upper surface, and wherein the bottom surface of the platform is concave, the convex upper surface of the resilient material contacting the concave bottom surface of the platform.

8. The toothbrush of claim 7 wherein the resilient material is an elastomeric material.

9. The toothbrush of claim 8 wherein the joint is a ball joint.

10. The toothbrush of claim 6 wherein the platform, the stem and the joint are integral and formed of a material that is harder than the resilient material.

* * * * *